United States Patent [19]

Rösler

[11] Patent Number: 4,995,513

[45] Date of Patent: Feb. 26, 1991

[54] CONTAINER FOR OBLONG ARTICLES

[75] Inventor: Peter Rösler, Wangen, Fed. Rep. of Germany

[73] Assignee: Rose-Plastic GmbH, Hergensweiler, Fed. Rep. of Germany

[21] Appl. No.: 508,935

[22] Filed: Apr. 12, 1990

[30] Foreign Application Priority Data

Apr. 13, 1989 [DE] Fed. Rep. of Germany ... 8904671[U]

[51] Int. Cl.[5] ..... B65D 85/24

[52] U.S. Cl. ..... 206/446; 206/45.31; 206/379; 206/518; 220/306; 220/339

[58] Field of Search ..... 206/45.31, 368, 379, 206/443, 446, 503, 518; 220/306, 307, 326, 339

[56] References Cited

U.S. PATENT DOCUMENTS

| | | | |
|---|---|---|---|
| 3,968,880 | 7/1976 | Ostrowsky | 220/306 |
| 4,030,602 | 6/1977 | Müller et al. | 220/306 |
| 4,431,113 | 2/1984 | Sims, Jr. | 220/306 |
| 4,671,408 | 6/1987 | Raines et al. | 220/339 |
| 4,708,259 | 11/1987 | Olimpio | 220/307 |
| 4,771,910 | 9/1988 | Roy | 220/306 |
| 4,883,193 | 11/1989 | Christensson | 220/339 |

FOREIGN PATENT DOCUMENTS

| | | | |
|---|---|---|---|
| 2815526 | 7/1979 | Fed. Rep. of Germany | 220/326 |

*Primary Examiner*—Jimmy G. Foster

*Attorney, Agent, or Firm*—Toren, McGeady & Associates

[57] ABSTRACT

A container for oblong articles includes a bottom wall, two side walls and two end walls connecting the side walls. A cover is pivotally attached through a film-type hinge to one of the end walls and is in its closed position in locking engagement with the other end wall. A tongue extends upwardly from the upper edge of each end wall. A flange and a web located inwardly from the flange extend downwardly from each end portion of the cover. In the closed position of the container, the tongue extends between the flange and the web and into a slot defined in the cover between the flange and the web and an inwardly projecting nose formed on the flange is received by a recess defined in the tongue.

12 Claims, 2 Drawing Sheets

CONTAINER FOR OBLONG ARTICLES

BACKGROUND OF THE INVENTION

1. Field of the Invention

The present invention relates to a packaging container for oblong articles. The container includes a lower part with a bottom wall, with two side walls extending from the bottom wall and diverging at the same angle and with two end walls which extend from the bottom wall and connect the side walls. The container further includes a cover for closing the opening formed by the free edges of the side walls and the end walls. The cover is pivotally attached through a hinge on one of the end walls and in its closed position is in locking engagement with the other end wall.

2. Description of the Related Art

A container of the above-described type made of plastics material is known and sold on the market. In this container, the lower part and the cover are made in a single piece, so that the container can only be constructed in a single color or transparent. In addition, due to the construction in a single piece, the molding tools for manufacturing the containers are expensive. Another disadvantage is the fact that when the covers are closed the containers cannot be stacked into each other and require substantial space for storage. In addition, the containers cannot be stacked because the end walls extend perpendicularly or almost perpendicularly relative to the bottom wall. Finally, the cover can be easily torn from the lower part, so that the lower part can no longer be closed for storing tools, such as drills, milling cutters, etc. In other words, the known container is a product which must be thrown away even if only the lower part or the cover are damaged.

SUMMARY OF THE INVENTION

It is the object of the present invention to further develop a container of the above-described type, so that the container can be manufactured in two colors or partially transparent, partially non-transparent. In addition, the lower parts of the containers should be stackable to a certain extent. Also, if a cover is damaged, the container should be closeable by means of a replacement cover, so that there is no unnecessary waste of material and the environmental damage is reduced. Moreover, it should be possible to place a supply of articles in the lower parts and then to stack the lower parts with the articles in a space-saving manner. Finally, it should be possible to mark the previously produced articles placed in the lower parts, for example, by means of laser beams with the company name, the trademark or name of origin, etc., and subsequently to package the articles by means of the cover.

In accordance with the present invention, the end walls of the lower part diverge from the bottom wall essentially at the same angle as the side walls. Each side wall has above half the height thereof and at the outer surface thereof a projecting wall portion which forms two lateral projections which extend downwardly from the upper edge of the end wall and a recess defined between the projections, the upper edges of the recess being spaced from the free edge of the end wall. An upwardly extending tongue is formed at the upper free edge of each end wall in the middle portion thereof above the recess. The cover to be combined with the lower part has at both end portions a web each which projects essentially perpendicularly from the inner surface of the cover and extends transversely of the longitudinal axis of the cover. When the container is closed, one of the wall surfaces of the web, i.e., the wall surface of the web facing the end walls, is in contact with the inner surface of the end wall of the lower part. The cover additionally has at each end at the inner surface thereof and outwardly in longitudinal direction of the cover from the above-mentioned web a flange each which also projects essentially perpendicularly and extends parallel to the web. The flange is constructed resilient or flexible and, when the cover is placed on the lower part, one of the wall surfaces, i.e., the wall surface facing the interior of the lower part, is in contact with each outer surface of the wall portions projecting from the end walls. The flange is provided with a projecting nose directed toward the adjacent end wall of the lower part. The nose can enter into the recess defined between the lateral projections and can reach a locking engagement with the upper edge of the recess. Furthermore, a slot is defined in the cover between each web and each flange, wherein the slots can receive the tongues which project upwardly from the upper edges of the end walls.

In a relatively flat container of the above-described type which is intended to receive essentially only one article in each container or several articles in only a single layer, the lower part and the cover are completely symmetrical with respect to the vertical longitudinal median plane and with respect to the vertical transverse median plane. The lower part and the cover may be made of different materials, for example, the lower part of the stiff, colored, relatively inexpensive plastics material and the cover of a more flexible, transparent material.

When the cover is pressed onto the lower part, the flanges provided with noses snap into and are locked in the recesses of the end walls of the lower part, wherein the webs of the cover and the upwardly projecting tongues hold the cover positively to the lower part in the predetermined position. For removing the cover from the lower part, it is sufficient to grasp the resilient flanges from below and to bend them outwardly so that the noses are moved out of the recesses. Since the lower part is constructed completely symmetrically, it is not necessary to observe a predetermined position when articles are placed in the lower part. This is a particular advantage when automated filling procedures are used.

Since four upwardly extending walls of the oblong, rectangular lower part diverge at essentially the same angle from the bottom wall, the lower parts can be stacked to a certain extent, so that storage space can be saved. The angle of inclination of the side walls and the end walls can be selected as desired. For example, if it is intended to keep a supply of stacked containers with articles placed in the containers until the articles are needed, the uppermost lower parts can move into the lower part below by approximately 1 to 2 mm, so that the containers can be safely stacked even when the lower parts are filled.

The filled lower parts which are stacked to provide a supply can then be removed as desired. It is possible to mark the articles in the lower parts, for example, by means of laser beams, in order to provide a tool in the lower part, for example, a drill or a milling cutter, etc., with identification. Subsequently, the cover is pressed on and the identification and packing process is concluded.

In accordance with a preferred feature of the invention, the cover is provided with a film-type hinge in the region of one end portion and with a gripping lug in the region of the other end portion. The film-type hinge is provided immediately adjacent the transversely extending web and inwardly from the web with respect to the longitudinal extension of the cover. The cover is securely held even during a pivoting movement thereof because of the locking engagement between the flange at the cover and the outer side of the end wall of the lower part and the contact of the web of the cover with the inner surface of the end wall and because of the tongue which engages in the slot in the cover. In order to facilitate the intended movement of the nose formed on the flange from the locking engagement with the recess in the lower part, the cover is provided at the end opposite the film-type hinge with an extension serving as a grip.

The lower part and the cover are preferably manufactured from plastics materials by injection molding. This makes it possible to manufacture several lower parts and several covers next to each other, wherein the adjacent lower parts and covers are held together to a certain extent by means of thin bridges which can be easily severed by means of bending or by cutting them with a knife in order to obtain the individual closed containers.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

The container according to the present invention is composed of two initially separate components, i.e., the lower part 1 and the cover 2.

The lower part 1 has two oppositely located end walls 1*b* which diverge upwardly from the bottom wall 1*a* and two oppositely located side walls *c* which also diverge upwardly from the bottom wall 1*a* essentially at the same angle as the end walls 1*b*.

Figure 3:
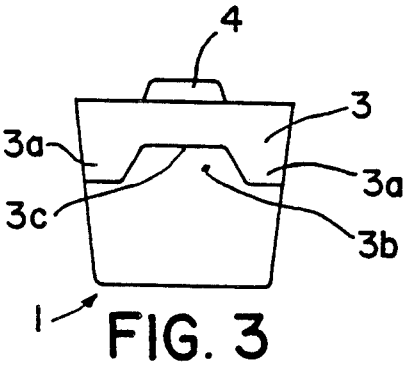
FIG. 3 is a front view of the lower part of the container.

Each end wall 1*b* has a projecting wall portion 3 above half the height of the wall. The wall portion 3 includes two projections 3*a* with a recess 3*b* being defined between the projections 3*a*. As shown in FIG. 3, the recess is trapeze-shaped. Each end wall has a tongue 4 which extends upwardly from the upper edge of the end wall and is located in the middle portion of the end wall. As also shown in FIG. 3, the tongue 4 is trapeze-shaped.

The cover 2 has an inner web 5 which is directed toward the lower part and extends over almost the entire width of the cover 2 or the width of the opening of the lower part 1. The outer wall surface of the inner web 5 is in contact with the inner wall surface of the end wall 1*b*. In addition, an outer flange 6 is formed at the inner surface of the cover 2 at the end portion thereof. The flange 6 has a nose 6*a* which is directed toward the end wall 1*b* of the lower part 1. The nose 6*a* can engage in the recess 3*b* and can reach locking contact with the upper edge 3*c* of the recess 3*b*, so that a secure connection is obtained between the cover 2 and the lower part 1. The flange 6 shown on the right hand side in FIG. 2 preferably has the same width as the lower part, while the flange on the left side has a shorter width. The nose 6*a* is beveled in order to facilitate the resilient outward movement of the flanges 6 when the cover 2 is pressed onto the lower part 1. Contrary to the hook-like nose 6*a* on the right hand side, the left flange 6 has a wedge-shaped nose 6*a* in order to facilitate the pulling-out of the flange 6 from the recess 3*b* when the cover 2 is opened.

The cover 2 has at both its end portions a transversely extending slot 7 in the middle in transverse direction for receiving the tongue 4 which extends upwardly from the lower part 1.

Figure 1:
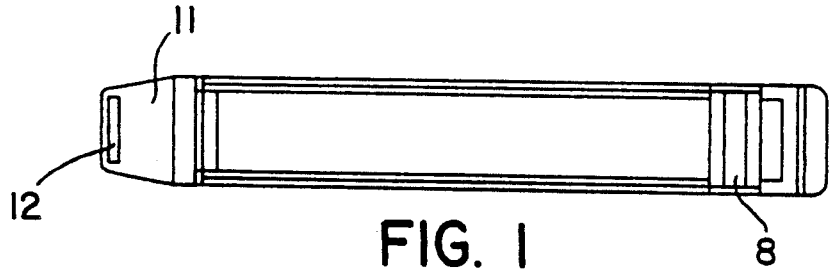
FIG. 1 is a top view of a container according to the present invention.
Figure 2:
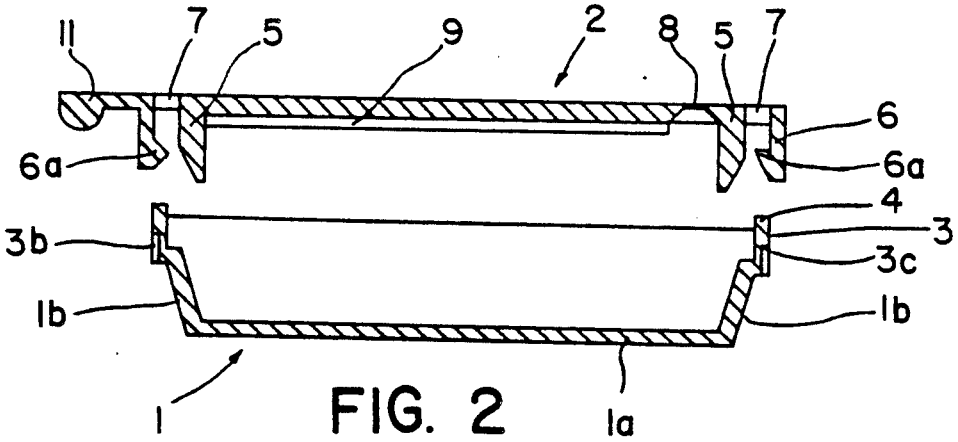
FIG. 2 is a longitudinal sectional view of the container of FIG. 1 with the cover being separated from the lower part.
Figure 4:
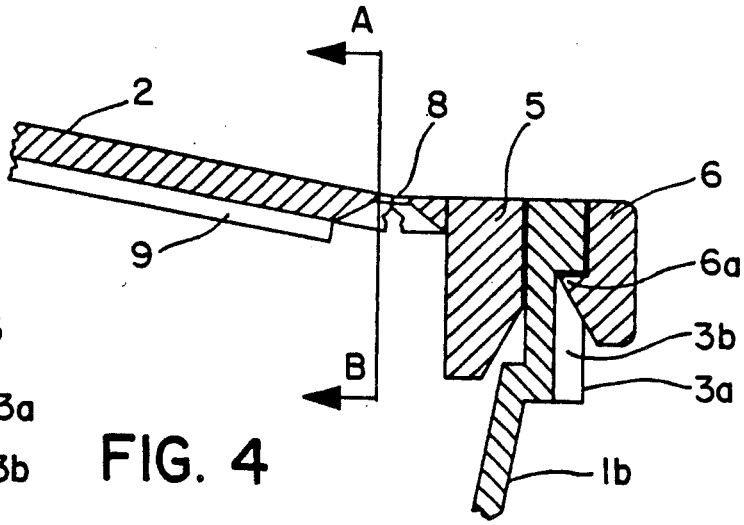
FIG. 4 shows a detail of the container on a larger scale.
Figure 5:
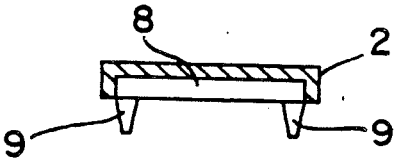
FIG. 5 is a sectional view taken along sectional line A—B in FIG. 4.

As illustrated in FIG. 2, a film-type hinge 8 is provided in the cover 2 adjacent the web 5 on the right hand side for facilitating a pivoting of the cover 2, as illustrated in detail in FIG. 4. However, the pivoting movement of the cover 2 is counteracted and a secure support of the cover on the lower part is ensured because of the hook-like nose 6*a* provided on the right hand side of the cover which engages in the recess 3*b* and because of the straight surfaces of the wall portion 3 which extend perpendicularly to the bottom wall 1*a* of the lower part 1.

The cover 2 is preferably provided in the region of its longitudinal edges with ribs 9. When the cover is closed, outer surfaces of the ribs 9 are in contact with inner surfaces of the side walls 1*c* of the lower part 1 and provide the cover with increased stiffness.

In accordance with another preferred feature, the end of the cover 2 located opposite the film-type hinge 8 is provided with an extension 11. The extension 11 forms a grip and may be provided for a slot or hole 12 to make it possible to hang up the container.

Figure 8:
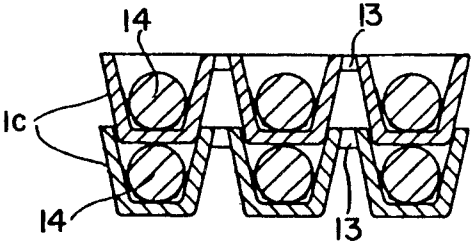
FIG. 8 is a transverse sectional view of stacked containers with articles placed therein.

As can be seen in FIG. 8, the angle of inclination of the side walls 1*c* of the lower part 1 and of the end walls 1*c* is selected in such a way that the lower parts 1 engage into each other up to a certain extent (approximately 2 mm) even if an article 14 is in each container. In the state shown in FIG. 8, the containers with articles 14 in them can be stacked in a space-saving manner and the articles can be marked, for example, by means of laser beams while the containers are still open.

Figure 9:
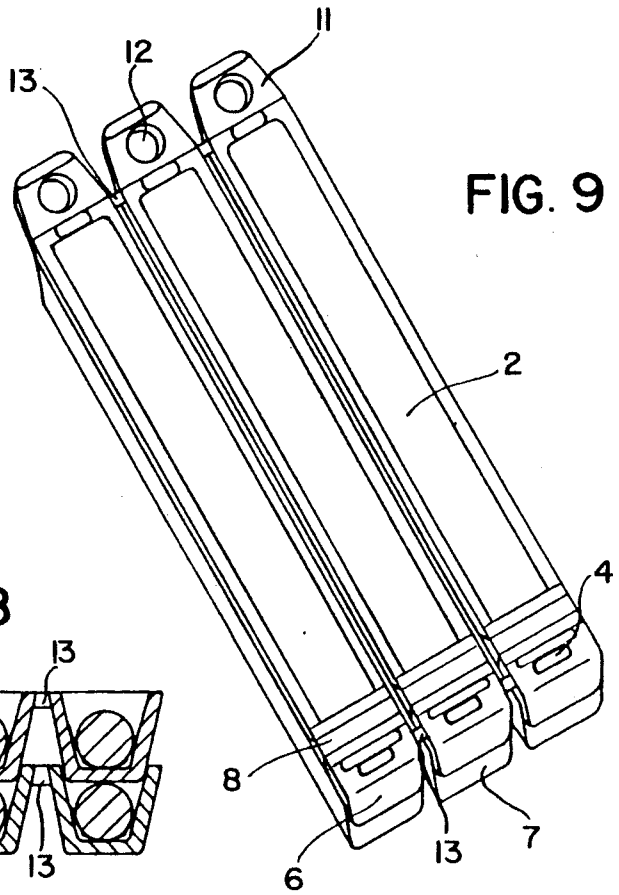
FIG. 9 is a perspective view of several completed and connected containers.

As also shown in FIGS. 8 and 9, several lower parts 1 and several covers 2 can be manufactured connected to each other by means of thin bridges 13 provided between the lower parts and between the covers. These thin bridges 13 can be torn or cut in order to separate a complete container from the other.

Figure 7A:
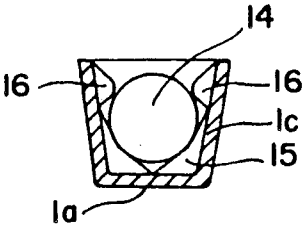
FIG. 7*a* is a transverse sectional view of a modified lower part with an article placed therein.
Figure 7B:
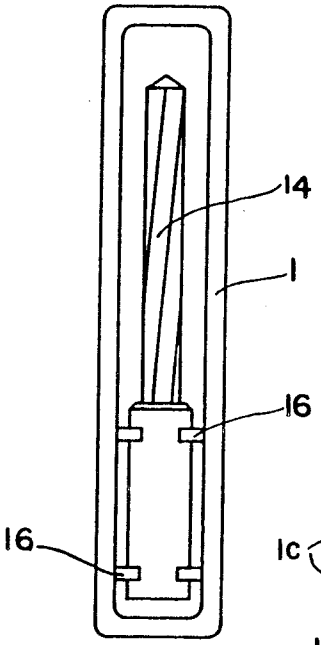
FIG. 7*b* is a top view of the lower part.
Figure 6A:
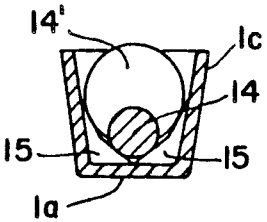
FIG. 6*a* is a transverse sectional view of the lower part with an article placed therein.
Figure 6B:
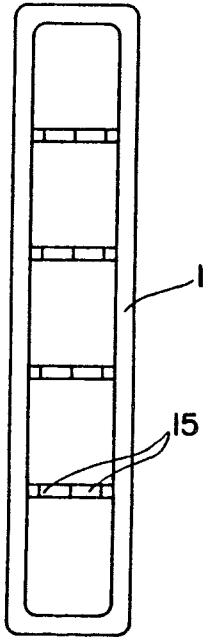
FIG. 6*b* is a top view of the lower part.

FIGS. 6 and 7 of the drawing show prism-shaped ribs 15 provided between the inner surfaces of the side walls 1*c* and the bottom walls 1*a* of the lower part for facilitating centering of an article 14 or 14' in the lower part without regard to the cross-sectional dimension of the article. This is of particular importance for an automatic marking of the articles 14, 14'. In addition, conical noses 16 can be provided in the upper portions of the side walls 1*c*, so that articles having circular cross-sections are better secured in their positions. Since the side walls 1*c* have a certain elasticity, the conical noses 16 do not impair the introduction of an article into the lower part 1.

Compared to the known containers described above, the container according to the present invention which is composed of two parts can be manufactured with less complicated molding tools. Because of their symmetrical construction, the lower parts can receive an article and can be stacked in a space-saving manner without having to maintain a predetermined alignment. The articles can be marked while being placed in the lower parts and the covers can only then be pressed onto the lower parts in a simple procedure which can be carried out automatically.

The various means for securing the cover in position including webs, flanges, locking noses and slots, which interact with elements of the lower part, ensure that a positive and secure connection can be effected between the cover and the lower part. The cover is also securely held on the lower part when the cover is pivoted about the film-type hinge.

The cover including the film-type hinge integrated in the cover is preferably made of a high-grade material, so that the container can also serve as a storage container which withstands frequent pivoting movements. However, if the cover should be destroyed, which is only likely to occur at the film-type hinge, a replacement cover can be placed on the original lower part for receiving and storing an article in a protective manner. The articles to be stored are primarily high-grade tools or instruments used in industry, in medicine, by artisans, etc.

While a specific embodiment of the invention has been shown and described in detail to illustrate the application of the inventive principles, it will be understood that the invention maybe embodied otherwise without departing from such principles.

I claim:

1. In a container for oblong articles, the container including a lower part having a bottom wall, two side walls extending from the bottom wall and diverging at the same angle and two end walls extending from the bottom wall and connecting the side walls, the end walls and the side walls having upper edges, the container further including a cover for closing the opening formed by the upper edges of the side walls and the end walls, the cover having an inner surface facing the lower part and a longitudinal axis, the cover being attached through a hinge at one of the end walls, the, cover being pivotable between a closed position and an open position, the cover being in a locking engagement with the end wall opposite the hinge when the cover is in the closed position, the improvement comprising the end walls of the lower part diverging from the bottom wall essentially at the same angle as the side walls, each side wall having above half the height thereof and at an outer surface thereof a projecting wall portion which defines two lateral projections which extend downwardly from the upper edge, of the end wall and a recess, with upper sides defined between the projections, the upper sides of the recess being spaced from the upper edge of the end wall, a tongue extending upwardly from the upper edge of each end wall in a middle portion thereof above the recess, the cover having at both ends thereof a web which projects essentially perpendicularly from the inner surface of the cover and extends transversely of the longitudinal axis of the cover, wherein, when the container is closed, a wall surface of the web facing the end wall is in contact with an inner surface of the end wall of the lower parts, the cover additionally having at each end and at the inner surface thereof and outwardly in longitudinal direction of the cover from the web a flange which projects essentially perpendicularly and extends parallel to the web, the flange being of resilient or flexible material and, when the cover is in the closed position, a wall surface of the flange facing the interior of the lower part being in contact with outer surfaces of the wall portions projecting from the end walls, the flange having a projecting nose directed toward the end wall of the lower part, the nose being movable into the recess defined between the lateral projections for obtaining a locking engagement with the upper side of the recess, and a slot being defined in the cover between each rib and flange for receiving the tongues which project upwardly from the upper edge of the end wall.

2. The container according to claim 1, wherein the recess in the projecting wall portion of each end wall is trapeze-shaped with sides which are upwardly and inwardly inclined towards the upper edge of the end wall.

3. The container according to claim 1, wherein the tongue extending upwardly from the upper edge of the end wall is trapeze-shaped with sides which are inclined downwardly and outwardly toward the upper edge of the end wall.

4. The container according to claim 1, wherein the hinge is a film-type hinge, the hinge being located immediately adjacent and inwardly relative to the longitudinal extension of the cover from one of the webs.

5. The container according to claim 4, wherein the cover and the film-type hinge are of a material which is of a higher grade and more durable than the material of the lower part.

6. The container according to claim 1, wherein the lower part comprises oppositely arranged ribs extending between the side walls and the bottom wall, the ribs being inclined relative to the bottom wall.

7. The container according to claim 1, wherein the side walls have inner surfaces, inwardly projecting noses being mounted on the inner surfaces at the upper edges of the side walls, the noses being spaced from the bottom wall.

8. The container according to claim 1, wherein the cover includes an extension forming a strip at one of the ends of the cover outside of the flange in longitudinal direction of the cover.

9. The container according to claim 8, wherein the extension defines an opening.

10. The container according to claim 1, wherein the lower part and the cover are constructed symmetrically relative to the vertical longitudinal median plane thereof.

11. The container according to claim 1, wherein the lower part and the cover are separate components prior to assembly of the container.

12. The container according to claim 1, wherein the lower part and each cover has a plurality of tearable thin bridges for connecting the lower part to another lower part and the cover to another cover, wherein at least one bridge is provided on either side of the hinge.

* * * * *